United States Patent [19]

Kato

[11] 4,088,102

[45] May 9, 1978

[54] AUXILIARY ACCELERATION FUEL FEED DEVICE IN AN INTERNAL COMBUSTION ENGINE

[75] Inventor: Takashi Kato, Susono, Japan

[73] Assignee: Toyota Jidosha Kogyo Kabushiki Kaisha, Toyota, Japan

[21] Appl. No.: 736,462

[22] Filed: Oct. 28, 1976

[30] Foreign Application Priority Data

Jan. 30, 1976 Japan ..... 51-008314

[51] Int. Cl.[2] ..... F02M 7/06; F02M 1/08; F02D 19/06

[52] U.S. Cl. ..... 123/119 R; 123/102; 123/103 R; 123/119 EC; 123/127; 123/139 A; 261/34 B

[58] Field of Search ..... 261/34 B, 34 A, 34 R, 261/36 A; 123/97 B, 103 R, 102, 127, 119 R, 119 EC, 139 A, 139 AJ, 106

[56] References Cited

U.S. PATENT DOCUMENTS

| | | | |
|---|---|---|---|
| 2,133,207 | 10/1938 | Mennesson | 261/34 A |
| 2,417,734 | 3/1947 | Carlson | 261/34 A |
| 2,458,990 | 1/1949 | Griffon | 261/36 A X |
| 2,472,692 | 6/1949 | Brown | 261/34 A |
| 3,437,081 | 4/1969 | Mennesson | 123/119 R |
| 3,475,994 | 11/1969 | Kell | 261/34 A |
| 3,677,241 | 7/1972 | Gele | 123/97 B |
| 3,911,062 | 10/1975 | Johnson | 261/34 B |
| 3,987,774 | 10/1976 | Wagg | 123/139 AJ |

*Primary Examiner*—Wendell E. Burns
*Attorney, Agent, or Firm*—Stevens, Davis, Miller & Mosher

[57] ABSTRACT

An auxiliary acceleration fuel feed device in an internal combustion engine used for a vehicle is disclosed. An auxiliary accelerator pump is provided for feeding an auxiliary acceleration fuel into the fuel supply passage of the engine in response to a decrease in the vacuum in the intake manifold. A vacuum control device in a vacuum conduit connecting the pump and the intake manifold is responsive to the engine temperature and the vehicle speed. The vacuum control device is arranged so as to close the vacuum conduit to prevent the supply of the fuel to the nozzle by the pump when the engine temperature and the vehicle speed is above respective predetermined levels.

5 Claims, 3 Drawing Figures

AUXILIARY ACCELERATION FUEL FEED DEVICE IN AN INTERNAL COMBUSTION ENGINE

DESCRIPTION OF THE INVENTION

The present invention relates to an auxiliary acceleration fuel feed device for feeding an auxiliary acceleration fuel into the intake system of an internal combustion engine.

A majority of conventional internal combustion engines are provided with carburetors equipped with an accelerator pump for injecting fuel into an intake manifold, simultaneously with injection of fuel from a main nozzle, at the time of acceleration in order to improve acceleration performance. However, before completion of warm-up, since the engine is still cold, vaporization of the fuel fed into the intake manifold is extremely low. Accordingly, if the automobile is started prior to completion of warm-up, and the engine is accelerated, even when the above accelerator pump is operated, the concentration of the air-fuel mixture is too low and thus acceleration performance is reduced. Particularly, in a lean combustion engine using a lean fuel mixture, when the concentration of the air fuel mixture is too low, the concentration is lower than the minimum value for combustion. Consequently there is a danger of a misfire taking place.

Not only when the engine is accelerated but also when an automobile is abruptly started on an upward slope, the concentration of the air-fuel mixture is excessively lowered. More specifically, when an automobile is started on an upward slope, the accelerator pedal is greatly depressed to increase the engine speed and the clutch is then engaged. In this case, even if the accelerator pedal is greatly depressed, the engine speed is greatly lowered after engagement of the clutch. At this point, even when depression of the accelerator pedal is great and hence, the degree of opening of the throttle valve is high, since the engine speed is low and the vacuum of the intake manifold is low, the amount of an introduced air is small and the supply of the fuel from either the slow system or the main system of the carburetor is temporarily stopped. At this point, even if fuel is fed from the accelerator pump, no satisfactory result is obtained and the concentration of the air-fuel mixture is reduced excessively.

Consequently, it is necessary to supply auxiliary fuel in addition to the fuel supplied from the accelerator pump when the automobile is started prior to completion of warming-up and the engine is accelerated, and also when the vehicle speed is low as on starting the automobile.

An object of the present invention is to provide an auxiliary fuel feed device of an extremely simple construction for an internal combustion engine of a vehicle, by which an auxiliary fuel can be fed into the intake manifold when the vehicle is accelerated prior to completion of warming-up and also when the vehicle speed is low.

According to the present invention there is provided an auxiliary acceleration fuel feed device in an internal combustion engine used for a vehicle, said engine having in a fuel supply passage, a carburetor having an acceleration pump for feeding an acceleration fuel into the fuel supply passage at the time of acceleration, an auxiliary accelerator nozzle disposed in the intake passage, an auxiliary accelerator pump in a fuel conduit connecting a supply of fuel with the auxiliary accelerator nozzle, the pump being operatively connected to the intake passage downstream of a throttle valve of the carburetor through a vacuum conduit so as to feed an auxiliary acceleration fuel to said nozzle in response to a decrease in the vacuum in the vacuum conduit, and a vacuum control device in the vacuum conduit responsive to the engine temperature and the vehicle speed and arranged so as to close the vacuum conduit to prevent the supply of the fuel to the nozzle by the pump when the engine temperature is above a predetermined level and the vehicle speed is above a predetermined level.

The above-mentioned object of the present invention may be more fully understood from the following descriptions of a preferred embodiment of the invention, together with the accompanying drawings.

DESCRIPTION OF A PREFERRED EMBODIMENT

Figure 1:
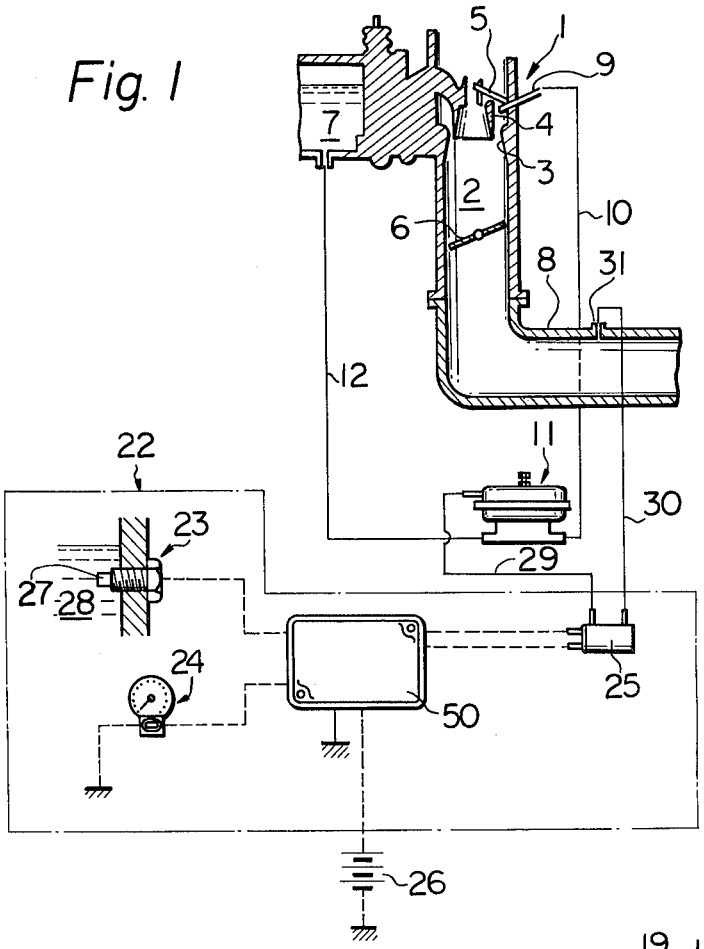
FIG. 1 is a schematic view of an auxiliary acceleration fuel feed device according to the present invention.

Referring to FIG. 1, a carburetor 1 has in a fuel passage 2 thereof a main venturi 3, a small venturi 4, a main nozzle 5 and a throttle valve 6. Fuel is fed into the main nozzle 5 from a fuel chamber, for example a fuel chamber 7 disposed in the carburetor 1, via a fuel passage (not shown). The fuel injected from the main nozzle 5 is delivered into engine cylinders (not shown) through the intake manifold 8. The carburetor 1 is further provided with an auxiliary fuel injection nozzle 9 which is connected to the fuel chamber 7 via a fuel supply conduit 10, a vacuum reactive pump 11 and a fuel supply conduit 12. In FIG. 1, the solid line indicates piping and the dotted line indicates electrical connections.

Figure 2:
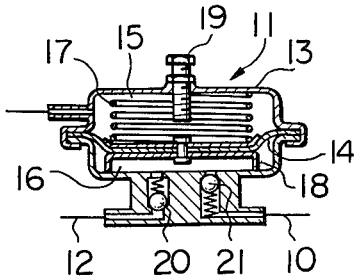
FIG. 2 is a cross-sectional view of the vacuum reactive pump in FIG. 1.

FIG. 2 shows a cross-sectional view of the vacuum reactive pump in FIG. 1. Referring to FIG. 2, the vacuum reactive pump 11 has in a housing 13 thereof a diaphragm chamber equipped with a diaphragm 14. The diaphragm chamber is divided into a first diaphragm chamber, i.e., a vacuum chamber 15, and a second diaphragm chamber, i.e., a pumping chamber 16 by means of the diaphragm 14. A return spring 17 is disposed between the diaphragm 14 and the inner wall of the housing 13, and a stop 18 fixed to the diaphragm 14 is disposed in the pumping chamber 16 to restrict the displacement of the diaphragm 14. Furthermore, an adjustment screw 19 projecting into the vacuum chamber 15 is screwed into a threaded hole in the housing 13 to limit the relaxation of the diaphragm 14 so as to control the amount of the fuel discharged from the pumping chamber 16. A first check valve 20 and a second check valve 21 are disposed in the housing 13. The first check valve 20 allows only inflow of fuel to the pumping chamber 16 from the fuel supply conduit 12 and the second check valve 21 allows only outflow of fuel to the fuel supply conduit 10 from the pumping chamber.

Returning to FIG. 1, a vacuum control device 22 comprises an engine temperature reactive device, for example a temperature reactive switch 23, a vehicle speed sensor 24, an electronic control device 50 and an electromagnetic valve 25. The output terminals of the temperature reactive switch 23 and the vehicle speed sensor 24 are connected to the electronic control device 50, the output terminal of which is in turn connected to the electromagnetic valve 25. The temperature reactive switch 23 has a temperature sensing portion 27 exposed to the engine cooling water, or engine lubricating oil 28, and senses the temperature of, for example, the cooling water 28. The switch 23 transmits an electrical signal indicating the warm-up state of the engine to the electronic control device 50. On the other hand, the vehicle speed sensor 24 senses vehicle speed and transmits an electrical signal indicating the speed to the electronic control device 50. The vacuum chamber 15 of the vacuum reactive pump 11 is connected to a vacuum outlet opening 31 via a vacuum conduit 29, an electromagnetic valve 25 and a vacuum conduit 30. When the vehicle speed is below a predetermined level or the temperature of the cooling water 28 is below a predetermined level, the electronic control device 50 is actuated by the output signal of the temperature reactive switch 23 or the vehicle speed sensor 24. This results in the electromagnetic valve 25 being connected to an electrical source 26, and thus the electromagnetic valve 25 opens to communicate with the vacuum chamber 15 and the interior of the intake manifold 8. Contrary to this, when the vehicle speed is above a predetermined level and the temperature of the cooling water 28 is above a predetermined level, the electromagnetic valve 25 closes to disconnect the vacuum chamber 15 from the interior of the intake manifold 8. That is, the electronic control device 50 functions as an OR circuit.

Assuming that warming-up of the engine is insufficient, and thus the temperature of the cooling water is low, the electronic control device 50 is actuated by means of the output signal of the temperature reactive switch 23. This results in the electromagnetic valve 25 opening and the vacuum chamber is opened to vacuum. When the throttle valve 6 is slightly opened and the automobile runs at a low speed, a large vacuum is produced in the intake manifold. Consequently a vacuum in the vacuum chamber 15 increases to the corresponding large vacuum, whereby the diaphragm 14 moves upwardly against a spring force of the return spring 17. Then, when the accelerator pedal is depressed in order to accelerate the engine and accordingly the throttle valve 6 is opened wide, the vacuum in the intake manifold decreases and, correspondingly, the vacuum in the vacuum chamber 15 decreases. This results in the diaphragm moving downwardly due to the spring force of the return spring 17. At this time, a liquid fuel in the pumping chamber 16 is injected from the auxiliary fuel injection nozzle 9 into the fuel passage 2 via the check valve 21 and the fuel supply conduit 10. Then, when the throttle valve is closed, a vacuum in the vacuum chamber 15 increases again, whereby the diaphragm 14 moves upwardly. At this time, a liquid fuel in the fuel chamber 7 is delivered into the pumping chamber 16 via the fuel supply conduit 12 and the check valve 20.

Also when the automobile is started, auxiliary fuel is injected from the auxiliary fuel injection nozzle 9 into the fuel passage 2. When the automobile is started, the vehicle speed is equal to zero. Consequently, the electronic control device 50 is actuated by means of the output signal of the vehicle speed sensor 24. This results in the electromagnetic valve 25 opening, whereby the vacuum chamber 15 is opened to the interior of the intake manifold. Thus, when the accelerator pedal is depressed in order to start the automobile and accordingly the throttle valve 6 is opened wide, an auxiliary fuel is injected from the auxiliary fuel injection nozzle 9 into the fuel passage 2 in the same manner as hereinbefore described.

Figure 3:
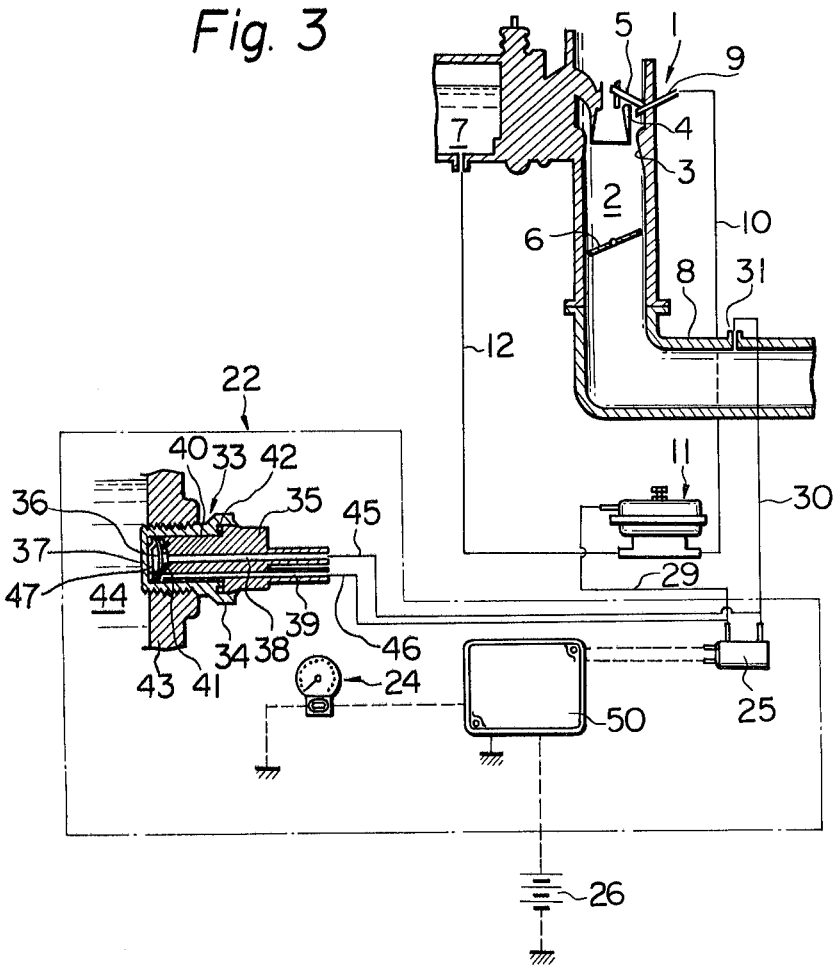
FIG. 3 is a schematic view of an alternative embodiment according to the present invention.

FIG. 3 shows an alternative embodiment of an auxiliary fuel feed device. This embodiment is different from the embodiment shown in FIG. 1 only in the vacuum control device 22. As the other elements are the same as in the embodiment shown in FIG. 1, a description of these elements is omitted. Referring to FIG. 3, the vacuum control device 22 comprises an engine temperature reactive device, for example a bimetal type temperature sensing valve 33, the vehicle speed sensor 24, the electronic control device 50 and the electromagnetic valve 25. The bimetal type temperature sensing valve 33 comprises a housing 34 with threads formed on it's outer periphery, a valve body 34 inserted into the housing 34, a disc shape bimetallic element 36 and a counter-spring 47 supporting the peripheral edge of the bimetallic element 36. The valve body 35 is provided with a central hole 38 and a side hole 39, and is further provided on its end face with an annular recess 40 connected to the central hole 38. O rings 41 and 42 for preventing leakage are disposed in the annular recess 40 and between the housing 34 and the valve body 35, respectively. The housing 34 is screwed into the engine body 43, one end of the housing 34 being disposed in the engine cooling water or the engine lubricating oil 44.

FIG. 3 illustrates the state where the temperature of, for example, the cooling water, is elevated above a predetermined level. At this time, the bimetallic element 36 is bent to close the annular recess 40 as shown in FIG. 3. Consequently, the central hole 38 and the side hole 39 are not interconnected with each other. On the other hand, when the temperature of, for example, the cooling water is cold, the bimetallic element 36 is flexed in the reverse direction, allowing communication between the central hole 38 and the side hole 39. That is, an opening and closing action of the bimetal type temperature sensing valve 33 is effected by virtue of the snap action of the bimetallic element 36. The central hole 38 is connected to the vacuum conduit 30 via a vacuum conduit 45, and the side hole 46 is connected to the vacuum conduit 29 via a vacuum conduit 46. Thus, the central hole 38 is connected to the interior of the intake manifold 8, and the side hole 39 is connected to the vacuum chamber 15 (see FIG. 2) of the vacuum reactive pump 11.

In the same manner as the embodiment shown in FIG. 1, when the vehicle speed is below a predetermined level, the electronic control device 50 is actuated by means of the output signal of the vehicle speed sensor 24. This results in the electromagnetic valve 25 opening to communicate the vacuum conduit 29 with the vacuum conduit 30. Consequently, when the automobile is started, the vacuum chamber 15 of the vacuum reactive pump 11 is opened to the interior of the intake manifold and, as is hereinbefore described, an auxiliary fuel is injected from the auxiliary fuel injection nozzle 9 into the fuel passage 2.

On the other hand, prior to completion of warming-up, that is, when the temperature of the cooling water 44 is below a predetermined level, the central hole 38 and the side hole 39 are interconnected with each other. Consequently, at this time the vacuum chamber 15 of the vacuum reactive pump 11 is opened to the interior of the intake manifold. Thus, as is hereinbefore described, an auxiliary fuel is injected from the auxiliary fuel injection nozzle 9 into the fuel passage 2 at the time of acceleration.

According to the present invention, the fuel mixture having an optimum air-fuel ratio can be always fed into the engine cylinders by providing the vacuum control device comprising simple combination of engine temperature reactive device, vehicle speed sensor, electronic control valve and electromagnetic valve.

What is claimed is:

1. An auxiliary acceleration fuel feed device in an internal combustion engine used for a vehicle, said engine having in a fuel supply passage, a carburetor having an acceleration pump for feeding an acceleration fuel into the fuel supply passage at the time of acceleration, comprising;

an auxiliary accelerator nozzle disposed in the intake passage, an auxiliary accelerator pump in a fuel conduit connecting a supply of fuel with the auxiliary accelerator nozzle, the pump being operatively connected to the intake passage downstream of a throttle valve of the carburetor through a vacuum conduit so as to feed an auxiliary acceleration fuel to said nozzle in response to a decrease in the vacuum in the vacuum conduit, and, a vacuum control device in the vacuum conduit responsive to the engine temperature and the vehicle speed and arranged so as to close the vacuum conduit to prevent the supply of the fuel to the nozzle by the pump when the engine temperature is above a predetermined level and the vehicle speed is above a predetermined level.

2. An auxiliary acceleration fuel feed device as recited in claim 1, wherein said auxiliary accelerator pump comprises a housing having a diaphragm therein, a vacuum chamber and a pumping chamber in the housing, which are separated by the diaphragm, said vacuum chamber being connected to the intake manifold downstream of the throttle valve via the vacuum conduit, a compression spring in the vacuum chamber arranged so as to bias the diaphragm, a first check valve disposed in the fuel conduit connecting the pumping chamber and the supply of fuel and allowing only inflow of the fuel to the pumping chamber from the supply of fuel, and a second check valve disposed in the fuel conduit connecting the pumping chamber and the nozzle and allowing only outflow of the fuel from the pumping chamber to the nozzle.

3. An auxiliary acceleration fuel feed device as recited in claim 1, wherein said vacuum control devices comprises a vehicle speed sensor, a temperature reactive switch and an electromagnetic valve in the vacuum conduit responsive to an electrical output from the vehicle speed sensor and the temperature reactive switch, the electromagnetic valve being arranged to close when the vehicle speed is above a predetermined level and the engine temperature is above a predetermined level.

4. An auxiliary acceleration fuel feed device as recited in claim 1, wherein said vacuum control device comprises a vehicle speed sensor, and an electromagnetic valve and an engine temperature reactive valve disposed in parallel in the vacuum conduit responsive to an electrical output from the vehicle speed sensor and responsive to change in temperature of the engine, respectively, the electromagnetic valve being arranged to close when the vehicle speed is above a predetermined level, the engine temperature reactive valve being arranged to close when the engine temperature is above a predetermined level.

5. An auxiliary acceleration fuel feed device as recited in claim 4, wherein said engine temperature reactive valve comprises a bimetal type temperature sensing valve.

* * * * *